US006855470B2

(12) United States Patent
Sata et al.

(10) Patent No.: US 6,855,470 B2
(45) Date of Patent: Feb. 15, 2005

(54) NONMAGNETIC BLACK TONER

(75) Inventors: Shinichi Sata, Wakayama (JP); Yoshihiro Ueno, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/259,320

(22) Filed: Sep. 30, 2002

(65) Prior Publication Data

US 2003/0099890 A1 May 29, 2003

(30) Foreign Application Priority Data

Sep. 28, 2001 (JP) ..... 2001-304617

(51) Int. Cl.[7] ..... G03G 13/08; G03G 9/09

(52) U.S. Cl. ..... 430/100; 430/108.6; 430/109.4; 430/111.4

(58) Field of Search ..... 430/108.6, 109.4, 430/111.4, 100

(56) References Cited

U.S. PATENT DOCUMENTS

| | | | | |
|---|---|---|---|---|
| 2,982,647 | A * | 5/1961 | Carlson et al. | 430/48 |
| 5,674,962 | A * | 10/1997 | Ito et al. | 526/323.1 |
| 6,130,017 | A | 10/2000 | Hayashi et al. | 428/403 |
| 6,660,442 | B2 * | 12/2003 | Sata et al. | 430/100 |
| 2002/0076635 | A1 | 6/2002 | Yoshino et al. | 430/106.2 |
| 2003/0017405 | A1 * | 1/2003 | Shimizu et al. | 430/108.1 |
| 2003/0054276 | A1 * | 3/2003 | Moriyama et al. | 430/106.2 |

OTHER PUBLICATIONS

Schaffert, M.A., PhD, *Electrophotography*, John Wiley & Sons, NY (1975), pp. 36–37.*

Neufeldt, V. et al, ed, *Webster's New World Dictionary*, Third College Edition, Simon & Schuster, Inc,NY( 1988)., p 1408.*

Schaffert, R.M, *Electrophotography*, John Wiley & Sons, NY ( 1975), p. 50.*

*Micro Patent Report* Abstract Describing JP 2000 10344A (2002).

*ESP @ cenet* Abstract Describing JP 2002 13865 (patent published 5/02).

*Micro patent Report* Abstract Describing JP 09 025126A (2002).

U.S. Appl. No. 10/259,320, filed Sep. 30, 2002, Sata et al.

U.S. Appl. No. 10/259,320, filed Nov. 26, 2002, Sata et al.

* cited by examiner

*Primary Examiner*—Janis L. Dote

(74) *Attorney, Agent, or Firm*—Oblon, Spivak, McClelland, Maier & Neustadt, P.C.

(57) ABSTRACT

A nonmagnetic black toner comprising a resin binder; and a clorant comprising a composite oxide of two or more metals, wherein the toner has a viscosity at its softening point of from $4.5\times10^3$ to $2.3\times10^4$ Pa·s. The nonmagnetic black toner can be suitably used for the development of a latent image formed in electrophotography, electrostatic recording method, electrostatic printing method or the like.

14 Claims, 1 Drawing Sheet

NONMAGNETIC BLACK TONER

BACKGROUND OF THE INVENTION

1. Field of the Invention

The present invention relates to a nonmagnetic black toner used for the development of a latent image formed in electrophotography, electrostatic recording method, electrostatic printing method or the like.

2. Discussion of the Related Art

Conventionally, carbon blacks have been used as a black colorant for a toner. However, the carbon blacks have some defects such that the volume specific resistance is low, so that triboelectric charges required for development cannot be maintained, whereby a sufficient degree of blackness cannot be obtained. In addition, there are also pointed out some problems in safety hygiene. Therefore, various composite oxides have been proposed as black colorants used in place of carbon black (Japanese Patent Laid-Open No. 2000-10344 (U.S. Pat. No. 6,130,017) and Japanese Patent Laid-Open No. Hei 9-25126.

On the other hand, recently, similar to the widespread trends in plain paper copy machines (PPC), there has been a remarkable progress in laser beam printers (LBP). In the case of the PPC, the development is carried out by forming an electrostatic latent image carrying electric charges on a photoconductor, and changing its surface potential by the intensity of the light source, thereby changing the image tone (charged area development). By contrast, in the case of LBP, since a latent image not having electric charges is formed by two-step of on-and-off, the area coverage modulation by the number of halftones is carried out (discharged area development, i.e. reversal development).

Therefore, in the case of reversal development, evenness of the individual toner particles are strongly demanded. However, since the composite oxide has low dispersibility, there are generated "empty particles" in which no colorant is included in a toner comprising the composite oxide as a colorant, thereby lowering the clarity of the fixed images.

An object of the present invention is to provide a nonmagnetic black toner comprising a black colorant useful for reversal development, and containing substantially no empty particles.

These and other objects of the present invention will be apparent from the following description.

SUMMARY OF THE INVENTION

According to the present invention, there is provided:

(1) a nonmagnetic black toner comprising:

a resin binder; and a colorant comprising a composite oxide of two or more metals, wherein the toner has a viscosity at its softening point of from $4.5\times10^3$ to $2.3\times10^4$ Pa·s; and (2) a process for development of a toner, comprising applying the nonmagnetic black toner of item (1) above to a development device for reversal development.

DETAILED DESCRIPTION OF THE INVENTION

Figure 1:
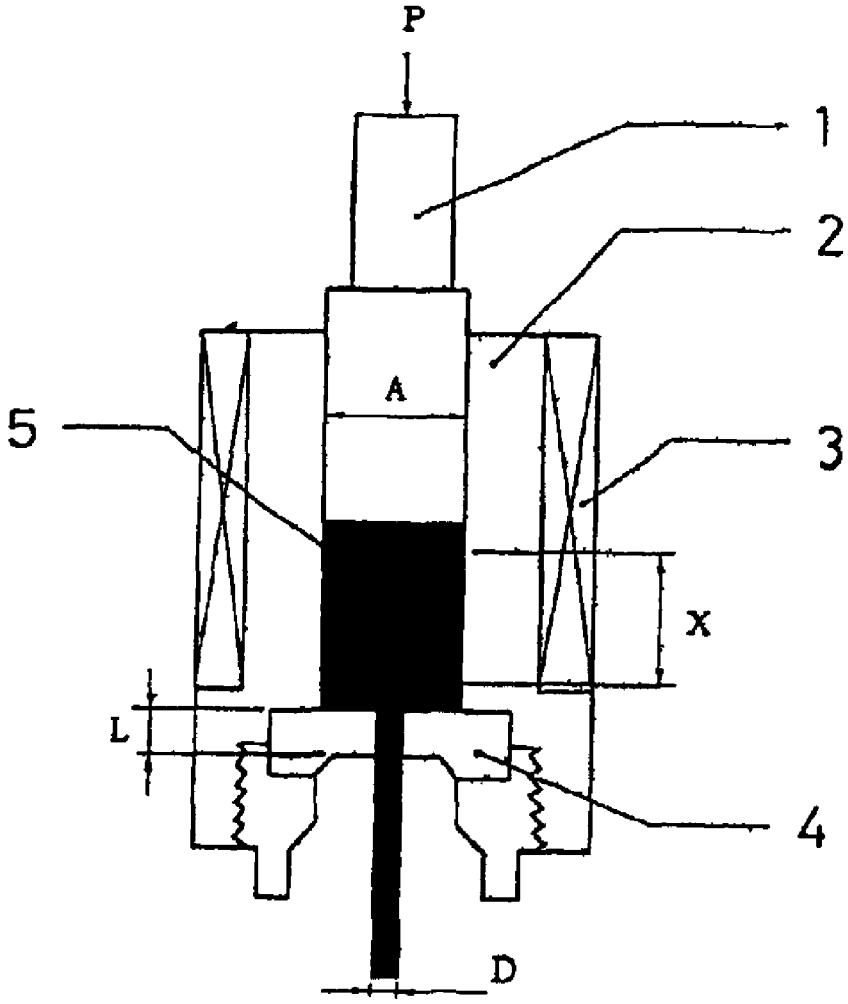
FIG. 1 is a schematic view showing the structure of koka-type flow tester used in the determination of viscosity of the toner of the present invention.

One of the features of the toner of the present invention resides in that the toner comprises a colorant comprising a composite oxide of two or more metals, wherein the toner has a particular viscosity. Usually, in a case where the colorant is a composite oxide of two or more metals, the composite oxide is not uniformly dispersed when the raw materials are melt-kneaded owing to the lowering of the dispersibility of the composite oxide itself, so that "empty particles" not containing the desired amount of the composite oxide are generated. By contrast, since in the toner of the present invention, the composite oxide is uniformly dispersed in the resin binder, the toner does not contain any empty particles, and has even degree of blackness. By the improvement in the dispersibility of the composite oxide, the toner can be made into a smaller size, and the transferability of the toner is also improved together with the uniform chargeability and the stability with the passage of time.

The toner of the present invention has a viscosity at its softening point of from $4.5\times10^3$ to $2.3\times10^4$ Pa·s, preferably from $6\times10^3$ to $2.1\times10^4$ Pa·s, more preferably from $8\times10^3$ to $2\times10^4$ Pa·s, especially preferably from $9.5\times10^3$ to $2\times10^4$ Pa·s.

In addition, the toner has a softening point of preferably from 95° to 160° C., more preferably from 105° to 140° C.

In the present invention, the composite oxide is constituted by at least 2 metals, from the viewpoint of the degree of blackness of the toner. Especially, it is preferable that at least one, preferably at least two, of the metals of the composite oxide belongs to Group 2, 13 or 14 of the Third Period of the Periodic Table, or to Groups 3 to 11 of the Fourth Period of the Periodic Table. Magnesium (Mg), aluminum (Al) and silicon (Si) belong to Group 2, 13 or 14 of the Third Period of the Periodic Table, and scandium (Sc), titanium (Ti), vanadium (V), chromium (Cr), manganese (Mn), iron (Fe), cobalt (Co), nickel (Ni) and copper (Cu) belong to Groups 3 to 11 of the Fourth Period of the Periodic Table. Among them, Mg, Al, Ti, Mn, Fe and Cu are preferable, and Mg, Al, Ti, Mn and Fe are especially preferable. The compositional ratio of the metals in the composite oxide is not particularly limited.

From the viewpoints of adjusting the affinity between the composite oxide and the resin binder and increasing the dispersibility of the composite oxide, the composite oxide in the present invention has an oil absorption per unit area of preferably 0.07 ml/m$^2$ or less, more preferably from 0.0001 to 0.05 ml/m$^2$, especially preferably from 0.001 to 0.02 ml/m$^2$. In the present invention, the above-mentioned oil absorption (ml/m$^2$) is calculated by the following equation using the oil absorption (ml/100 g) as determined by the method according to JIS K5101 and the specific surface area (m$^2$/100 g):

$$\text{Oil Absorption Per Unit Area (ml/m}^2\text{)} = \frac{\text{Oil Absorption (ml/100 g)}}{\text{Specific Surface Area (m}^2\text{/100 g)}}$$

The composite oxide has an average particle size of preferably from 5 nm to 1 $\mu$m, more preferably from 5 to 500 nm, especially preferably from 5 to 200 nm, from the viewpoints of the oil absorption and the covering strength.

The content of the composite oxide is preferably from 4 to 30% by weight, more preferably from 4 to 20% by weight, especially preferably from 7 to 15% by weight, of the toner, from the viewpoints of the degree of blackness and the specific gravity of the toner.

The process for preparing a composite oxide includes a process comprising depositing other oxide on a surface of the main oxide used as a core particle (Japanese Patent Laid-Open No. 2000-10344 (U.S. Pat. No. 6,130,017)), a process of making a composite oxide comprising sintering several oxides (Japanese Patent Laid-Open No. Hei 9-25126), and the like, without being particularly limited thereto.

The preferable commercially available composite oxide in the present invention includes "Dye Pyroxide Black No. 1," "Dye Pyroxide Black No. 2" (hereinabove commercially available from DAINICHISEIKA COLOR & CHEMICALS MFG. CO., LTD.), "HSB-603Rx," "HSB-605" (hereinabove commercially available from Toda Kogyo Corp.), "ETB-100" (commercially available from Titan Kogyo K.K.), MC Series (commercially available from MITSUI MINING & SMELTING CO., LTD.), and the like.

The resin binder in the present invention includes polyesters, vinyl resins such as styrene-acrylic resins, epoxy resins, polycarbonates, polyurethanes, hybrid resins in which two or more resin components are partially chemically bonded to each other, and the like, without being particularly limited thereto. Among them, from the viewpoints of the dispersibility and the transferability of the colorant, the polyester and the hybrid resin comprising a polyester component and a vinyl resin component are preferable, and the polyester is more preferable. The content of the polyester is preferably from 50 to 100% by weight, more preferably from 80 to 100% by weight, especially preferably 100% by weight, of the resin binder. The hybrid resin may be obtained by using two or more resins as raw materials, or it may be obtained by using one resin and raw material monomers of the other resin. Further, the hybrid resin may be obtained from a mixture of raw material monomers of two or more resins. In order to efficiently obtain a hybrid resin, those obtained from a mixture of raw material monomers of two or more resins are preferable.

It is preferable that the alcohol component of the polyester contains an alkylene oxide adduct of bisphenol A represented by the formula (I):

(I)

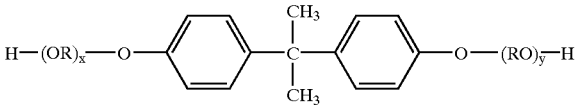

wherein R is an alkylene group having 2 or 3 carbon atoms; each of x and y is a positive number, wherein a sum of x and y is from 1 to 16, preferably from 1.5 to 5.0.

The alkylene oxide adduct of bisphenol A represented by the formula (I) includes an alkylene (2 to 3 carbon atoms) oxide(average number of moles: 1 to 16) adduct of bisphenol A such as polyoxypropylene(2.2)-2,2-bis(4-hydroxyphenyl)propane and polyoxyethylene(2.0)-2,2-bis(4-hydroxyphenyl)propane, and the like.

It is desired that the content of the alkylene oxide adduct of bisphenol A represented by the formula (I) in the alcohol component is 5% by mol or more, preferably 50% by mol or more, more preferably 100% by mol, from the viewpoint of satisfying both the low-temperature fixing ability and the durability.

In addition, the alcohol component other than the alkylene oxide adduct of bisphenol A includes ethylene glycol, propylene glycol, glycerol, pentaerythritol, trimethylolpropane, hydrogenated bisphenol A, sorbitol, and alkylene (2 to 4 carbon atoms) oxide(average number of moles: 1 to 16) adducts thereof. These alcohol components can be used alone or in admixture of two or more kinds.

In addition, the carboxylic acid component of the polyester is preferably an aromatic dicarboxylic acid compound such as terephthalic acid, isophthalic acid, phthalic acid, an alkyl (1 to 8 carbon atoms) ester thereof; an acid anhydride thereof; and the like, more preferably terephthalic acid, from the viewpoint of adjusting the viscosity at the softening point of the toner. The content of the aromatic dicarboxylic acid compound in the carboxylic acid component is preferably from 10 to 100% by mol, more preferably from 20 to 80% by mol.

In addition, the carboxylic acid component other than the aromatic dicarboxylic acid compound includes dicarboxylic acids such as fumaric acid, maleic acid, and adipic acid; a substituted succinic acid of which substituent is an alkyl group having 1 to 20 carbon atoms or an alkenyl group having 2 to 20 carbon atoms, such as dodecenylsuccinic acid and octylsuccinic acid; tricarboxylic or higher polycarboxylic acids such as 1,2,4-benzenetricarboxylic acid (trimellitic acid) and pyromellitic acid; acid anhydrides thereof; alkyl (1 to 8 carbon atoms) esters thereof; and the like. These carboxylic acid components can be used alone or in admixture of two or more kinds.

The polyester can be prepared by, for instance, polycondensation of an alcohol component with a carboxylic acid component at a temperature of 180° to 250° C. in an inert gas atmosphere in the presence of an esterification catalyst as desired.

During the preparation of the polyester, in order to obtain a polyester having the same level of viscosity as that desired for the toner, it is preferable that the reaction end point is determined with monitoring the viscosity.

Therefore, like the viscosity desired for the toner, the polyester has a viscosity at its softening point of preferably from $4.5\times10^3$ to $2.3\times10^4$ Pa·s, more preferably from $5\times10^3$ to $2\times10^4$ Pa·s, especially preferably from $6\times10^3$ to $2\times10^4$ Pa·s.

In addition, it is preferable that the polyester has a softening point of from 80° to 165° C., and a glass transition point of from 50° to 85° C.

It is preferable that the polyester has an acid value of from 0.5 to 60 mg KOH/g, from the viewpoint of the dispersibility of the colorant and the transferability, and that the polyester has a hydroxyl value of from 1 to 60 mg KOH/g.

Since the properties of the toner greatly depend on the properties of the resin binder, it is preferable that the resin binder also has the similar viscosity to that desired for a toner. From the above viewpoint, the concentration of the aromatic functional group in the raw material monomers constituting the resin binder is preferably from 20 to 70% by weight, more preferably from 25 to 50% by weight, especially preferably from 30 to 50% by weight. The term "concentration of the aromatic functional group" refers to a weight ratio of the aromatic functional group in a total amount of the raw material monomers constituting the resin binder, wherein the aromatic functional group is an aryl group such as phenyl, or an arylene group such as phenylene group. In the case where the aromatic functional group has a substituent, the weight ratio is calculated by replacing the substituent with a hydrogen atom.

The toner of the present invention may appropriately contain, in addition to the resin binder and the colorant, an additive such as a charge control agent, a releasing agent, a fluidity improver, an electric conductivity modifier, an extender, a reinforcing filler such as a fibrous substance, an antioxidant, an anti-aging agent, and a cleanability improver.

The toner of the present invention can be prepared by any of conventionally known methods such as kneading and pulverization method, and polymerization method. Concretely, in a case of a pulverized toner prepared by kneading and pulverization method, for instance, the method comprises homogeneously mixing a resin binder, a colorant, and the like in a mixer such as a HENSCHEL™ mixer or a ball-mill, thereafter melt-kneading with a closed kneader or a single-screw or twin-screw extruder, cooling, pulverizing and classifying the product. The volume-average particle size of the toner is preferably from 3 to 15 $\mu$m. Especially in the toner having a smaller particle size of 3 to 10 $\mu$m, the effects of the present invention are more remarkably exhibited. Further, a fluidity improver such as hydrophobic silica or the like may be added to the surface of the toner as an external additive as occasion demands.

The nonmagnetic black toner of the present invention can be made into a small size by the improvement in the dispersibility of the composite oxide, and the transferability of the toner is improved together with the uniform chargeability and the stability with the passage of time, so that the transferring of fine halftones can be facilitated, thereby making it highly useful as a toner for reversal development. Since the triboelectric charges can be stably maintained, the toner can be also preferably used in the nonmagnetic monocomponent development. In the present invention, the term "nonmagnetic toner" refers to a paramagnetic material, a diamagnetic material, or a ferromagnetic material having a saturation magnetization of 10 $Am^2/kg$ or less, preferably 2.5 $Am^2/kg$ or less.

Further, the nonmagnetic black toner of the present invention is similar to the resistance of colorants such as yellow, cyan and magenta, the nonmagnetic black toner can be suitably used in the formation of full-color fixed images.

Furthermore, the present invention provides a process for development of a toner, comprising applying the nonmagnetic black toner of the present invention to a development device for reversal development. In this process, it is preferable that the development device is a device for nonmagnetic monocomponent development, or a device for full-color development.

EXAMPLES

[Average Particle Size of Composite Oxide]

The number-average particle size is determined by measuring from an electron micrograph.

[Oil Absorption (ml/100 g) of Composite Oxide]

The oil absorption of linseed is determined by a method according to JIS K 5101.

[Specific Surface Area ($m^2$/100 g) of Composite Oxide]

The specific surface area is determined by the nitrogen adsorption method (BET method).

[Acid Value of Resin]

The acid value is determined by a method according to JIS K 0070.

[Glass Transition Point of Resin]

The glass transition point is determined using a differential scanning calorimeter "DSC 210" (commercially available from Seiko Instruments, Inc.) with raising the temperature at a rate of 10° C./min.

[Weight-Average Molecular Weight of Resin]

The weight-average molecular weight is determined by the GPC Method (column: GMHLX+G3000HXL (commercially available from Tosoh Corporation), standard sample: monodispersed polystyrene).

[Softening Points and Viscosities of Resin and Toner]

The softening point is determined using a flow tester of the "koka" type "CFT-500D" (commercially available from Shimadzu Corporation), which has a structure shown in FIG. 1. Specifically, a sample 5 filled in a cylinder 2 is heated and melted by a heater 3, and a given amount of load is applied from the upper side with a piston 1 (sample: 1 g, rate of raising temperature: 6° C./min, load: 1.96 MPa, nozzle diameter: 1 mm, and nozzle length: 1 mm). The softening point refers to a temperature at which a half of the sample flows out through a nozzle 4.

The viscosity is calculated by the following equation based on the relationship between the shear stress and flow rate determined with the flown-out sample.

Flow Rate ($Q$) (1)

$$Q(\mathrm{cm}^3/s) = \frac{X}{10} \cdot \frac{A}{t}$$

wherein t is a time period (s) for determination, X is a moving distance (mm) of piston for the time period t, and A is a cross section ($cm^2$) of piston.

Viscosity ($\eta$) (2)

$$\eta = \frac{\pi D^4 P}{128LQ} \times 10^{-3} (\mathrm{Pa} \cdot s)$$

wherein D is a nozzle diameter (mm), P is a test pressure [load/cross-sectional area of piston] (Pa), L is a nozzle length (mm), and Q is a flow rate.

Resin Preparation Example

The raw material monomers as shown in Table 1 and 50 g of dibutyltin oxide were reacted under a nitrogen gas atmosphere, with stirring the ingredients at 230° C. The reaction was allowed to proceed until the softening point, as determined according to ASTM D36-86, reached the desired temperature, to give each of Polyesters 1 to 9. The molar ratio of carboxylic acid component (A) to alcohol component (G), and the softening point (Tm), the glass transition point (Tg), acid value (AV) and the concentration of aromatic functional group of each resin are shown in Table 1.

In addition, a copolymer resin of styrene/n-butyl methacrylate (weight ratio=65/35, weight-average molecular weight: 67000) is also listed in Table 1 as Styrene-Acrylic Resin 1.

TABLE 1

| | Polyester 1 | Polyester 2 | Polyester 3 | Polyester 4 | Polyester 5 | Polyester 6 | Polyester 7 | Polyester 8 | Polyester 9 | Styrene-Acrylic Resin 1 |
|---|---|---|---|---|---|---|---|---|---|---|
| BPA-PO[1)] Mw = 350 | 12250 g (35) | 12250 g (35) | 35000 g (100) | 24500 g (70) | 17500 g (50) | 24500 g (70) | 24500 g (70) | 24500 g (70) | 24500 g (70) | |
| BPA-EO[2)] Mw = 325 | 21125 g (65) | 21125 g (65) | | 9750 g (30) | 16250 g (50) | 9750 g (30) | 9750 g (30) | 9750 g (30) | 9750 g (30) | |

TABLE 1-continued

| | Polyester 1 | Polyester 2 | Polyester 3 | Polyester 4 | Polyester 5 | Polyester 6 | Polyester 7 | Polyester 8 | Polyester 9 | Styrene-Acrylic Resin 1 |
|---|---|---|---|---|---|---|---|---|---|---|
| Terephthalic Acid Mw = 166 | 4980 g (35) | 15252 g (92) | 6640 g (40) | 8466 g (51) | 11454 g (69) | 7470 g (45) | 7470 g (45) | 9628 g (58) | 12450 g (75) | |
| Fumaric Acid Mw = 116 | 8120 g (70) | | 3944 g (34) | | | | | | | |
| Trimellitic Anhydride Mw = 192 | | | | 1920 g (10) | 4800 g (25) | 4800 g (25) | 4800 g (25) | 3072 g (16) | 4800 g (25) | |
| Adipic Acid Mw = 146 | | | 4380 g (30) | | | | | | | |
| Dodecenylsuccinic Acid Mw = 268 | | | | 10452 g (39) | 1608 g (6) | 8040 g (30) | 8040 g (30) | 3216 g (12) | | |
| A/G | 1.0 | 0.92 | 1.04 | 1.0 | 1.0 | 1.0 | 1.0 | 0.86 | 1.0 | |
| Tm (° C.) | 90 | 112 | 98 | 111 | 121 | 136 | 151 | 148 | 164 | 143 |
| Tg (° C.) | 51 | 65 | 51 | 63 | 65 | 64 | 61 | 63 | 73 | 64 |
| AV (mg KOH/g) | 13.5 | 5.0 | 19.4 | 9.2 | 15.4 | 22.4 | 17.9 | 6.4 | 12.1 | — |
| Concentration of Aromatic Functional Group (% by weight) | 37.6 | 45.6 | 36.5 | 36.0 | 43.3 | 37.6 | 37.6 | 41.5 | 44.3 | 48.1 |

Note)
The used amount in parentheses is expressed by molar ratio.
1)Propylene oxide adduct of bisphenol A (2.2 mol)
2)Ethylene oxide adduct of bisphenol A (2.2 mol)

Here, in Table 1, the concentration of aromatic functional group for, for instance, Polyester 1 is calculated, assuming that the total atomic weight of the aromatic functional group ($C_6H_4$) is 76, as follows:

$$\frac{\frac{76\times 2}{350}\times 12250+\frac{76\times 2}{325}\times 21125+\frac{76}{166}\times 4980+\frac{76}{192}\times 0}{12250+21125+4980+8120}\times 100.$$

Also, the concentration of aromatic functional group for Styrene-Acrylic Resin 1 is calculated, assuming that total atomic weight of the aromatic functional group ($C_6H_5$) is 77, as follows:

$$\frac{65000\times 0.65\times \frac{77}{104}}{65000}\times 100.$$

EXAMPLES 1 TO 13 AND COMPARATIVE EXAMPLES 1 AND 2

The amount 7000 g of a resin binder as shown in Table 3, 700 g of a colorant as shown in Table 3, 70 g of a polypropylene wax "NP-055" (commercially available from MITSUI CHEMICALS, INC.), and 70 g of a charge control agent "S-34" (commercially available from Orient Chemical Co., Ltd.) were supplied into a HENSCHEL™ Mixer, and mixed at a mixer temperature of 40° C. for 3 minutes with stirring, to give a mixture. The resulting mixture was melt-kneaded at 100° C. with a continuous twin-screw kneader, to give a kneaded product. The kneaded product was then cooled in the air, roughly pulverized and finely pulverized, and then classified, to give a powder having a volume-average particle size of 8.5 μm.

The amount 1000 g of the resulting powder and 8 g of a hydrophobic silica "R-972" (commercially available from Nippon Aerosil; average particle size: 16 nm) were mixed with a HENSCHEL™ mixer for 3 minutes with stirring, to give a black toner.

The average particle size, the oil absorption and the like of the composite oxides used in Examples and Comparative Examples are shown in Table 2.

TABLE 2

| Composite Oxide | Average Particle Size (μm) | Oil Absorption (A) (ml/100 g) | Specific Surface Area (B) ($m^2$/100 g) | (A)/(B) | Major Metal Contained |
|---|---|---|---|---|---|
| Dye Pyroxide Black No. 2 (commercially available from DAINICHISEIKA COLOR & CHEMICALS MFG. CO., LTD.) | 0.01 | 22 | 5600 | 0.0039 | Fe, Mn, Cu |
| ETB-100 (commercially available from Titan Kogyo K.K.) | 0.25 | 30 | 480 | 0.0625 | Ti, Fe |
| MC-6 (commercially available from MITSUI MINING & SMELTING CO., LTD.) | 0.02 | 93 | 6940 | 0.0134 | Fe, Mn |
| MC-7 (commercially available from MITSUI MINING & SMELTING CO., LTD.) | 0.02 | 72 | 5540 | 0.0130 | Fe, Mn |
| HSB-605 (commercially available from Toda Kogyo Corp) | 0.15 | 18 | 600 | 0.0300 | Fe, Mn |

TABLE 2-continued

| Composite Oxide | Average Particle Size (μm) | Oil Absorption (A) (ml/100 g) | Specific Surface Area (B) ($m^2$/100 g) | (A)/(B) | Major Metal Contained |
|---|---|---|---|---|---|
| MC-10 (commercially available from MITSUI MINING & SMELTING CO., LTD.) | 0.1 | 51 | 4160 | 0.0123 | Fe, Mg, Al |

Test Example 1

A small amount of a toner was evenly placed on a slide glass, and exposed to transmission light under an optical microscope adjusted to a magnification of 600. The proportion of toners containing no colorant (empty particles) was visually observed, and evaluated by the following evaluation criteria. The results are shown in Table 3.

[Evaluation Criteria]

⊙: Especially excellent, with no amount of empty particles observed;

○: Excellent for practical use, with little amount of empty particles observed;

Δ: Borderline for practical use, with amount of empty particles being observed; and ×: Not preferable for practical use, with a large amount of empty particles observed;

TABLE 3

| | Resin Binder | Colorant (Composite Oxide) | Softening Point of Toner (° C.) | Viscosity at Softening Point of Toner (Pa · s) | Proportion of Empty Particles* |
|---|---|---|---|---|---|
| Example 1 | Polyester 2 | Dye Pyroxide Black No. 2 | 114 | $5.0 \times 10^3$ | Δ(10) |
| Example 2 | Polyester 3 | Dye Pyroxide Black No. 2 | 100 | $5.8 \times 10^3$ | Δ(8) |
| Example 3 | Polyester 4 | Dye Pyroxide Black No. 2 | 114 | $7.0 \times 10^3$ | Δ(6) |
| Example 4 | Styrene-Acrylic Resin 1 | Dye Pyroxide Black No. 2 | 143 | $9.3 \times 10^3$ | ○(5) |
| Example 5 | Polyester 5 | Dye Pyroxide Black No. 2 | 124 | $1.0 \times 10^4$ | ⊙(2) |
| Example 6 | Polyester 6 | Dye Pyroxide Black No. 2 | 139 | $1.0 \times 10^4$ | ⊙(1) |
| Example 7 | Polyester 7 | Dye Pyroxide Black No. 2 | 154 | $1.6 \times 10^4$ | ⊙(1) |
| Example 8 | Polyester 8 | Dye Pyroxide Black No. 2 | 151 | $1.6 \times 10^4$ | ○(4) |
| Example 9 | Polyester 2 | ETB-100 | 113 | $1.0 \times 10^4$ | ○(3) |
| Example 10 | Polyester 2 | MC-6 | 115 | $1.0 \times 10^4$ | ○(4) |
| Example 11 | Polyester 2 | MC-7 | 113 | $1.0 \times 10^4$ | ⊙(1) |
| Example 12 | Polyester 2 | HSB-605 | 113 | $1.0 \times 10^4$ | ○(3) |
| Example 13 | Polyester 6 | MC-10 | 137 | $1.0 \times 10^4$ | ⊙(1) |
| Comparative Example 1 | Polyester 1 | Dye Pyroxide Black No. 2 | 91 | $4.1 \times 10^3$ | X(12) |
| Comparative Example 2 | Polyester 9 | Dye Pyroxide Black No. 2 | 168 | $2.4 \times 10^4$ | X(12) |

*The value in parenthesis is a proportion of empty particles expressed in % on a number basis.

It is seen from the above results that the proportions of empty particles are low in the toners of Examples 1 to 13, while the proportions of empty particles are high in the toners of Comparative Examples 1 and 2 which do not have the desired viscosity properties.

Test Example 2

Each of the toners obtained in Examples 1 to 13 was loaded in a nonmagnetic, monocomponent laser printer for reversal development "Microline 703n" (commercially available from Oki Data Corporation), and 50 sheets of black solid images were printed. As a result, it was confirmed that images having a sufficient image density, no white spots, and less image fogging could be obtained.

According to the present invention, there can be provided a nonmagnetic black toner useful for reversal development, comprising a black colorant and containing no empty particles.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A nonmagnetic black toner comprising:

a resin binder; and a colorant comprising a composite oxide of two or more metals, wherein the toner has a viscosity at its softening point of from $4.5 \times 10^3$ to $2.3 \times 10^4$ Pa·s and a softening point of from 95° to 160° C.

2. The nonmagnetic black toner according to claim 1, wherein a concentration of an aromatic functional group in raw material monomers constituting the resin binder is from 20 to 70% by weight.

3. The nonmagnetic black toner according to claim 1, wherein at least one metal constituting the composite oxide is an element selected from the group consisting of magnesium (Mg), aluminum (Al), titanium (Ti), manganese (Mn) and iron (Fe).

4. The nonmagnetic black toner according to claim 1, wherein the composite oxide is contained in an amount of 4 to 30% by weight of the toner.

5. The nonmagnetic black toner according to claim 1, wherein the composite oxide has an oil absorption per unit area of 0.07 $ml/m^2$ or less.

6. The nonmagnetic black toner according to claim 1, wherein a concentration of an aromatic functional group in raw material monomers constituting the resin binder is from 25 to 50% by weight.

7. In a process for forming an image by reversal development, the improvement comprising using the nonmagnetic black toner of claim 1.

8. A nonmagnetic black toner comprising:

a resin binder; and a colorant comprising a composite oxide of two or more metals, wherein the toner has a viscosity at its softening point of from $4.5\times10^3$ to $2.3\times10^4$ Pa·s, wherein the resin binder comprises a polyester.

9. The nonmagnetic black toner according to claim 8, wherein the polyester has a viscosity at its softening point of $4.5\times10^3$ to $2.3\times10^4$ Pa·s.

10. The nonmagnetic black toner according to claim 8, wherein a concentration of an aromatic functional group in raw material monomers constituting the resin binder is from 20 to 70% by weight.

11. The nonmagnetic black toner according to claim 8, wherein at least one metal constituting the composite oxide is an element selected from the group consisting of magnesium (Mg), aluminum (Al), titanium (Ti), manganese (Mn) and iron (Fe).

12. The nonmagnetic black toner according to claim 8, wherein the composite oxide is contained in an amount of 4 to 30% by weight of the toner.

13. The nonmagnetic black toner according to claim 8, wherein the composite oxide has an oil absorption per unit area of 0.07 $ml/m^2$ or less.

14. The nonmagnetic black toner according to claim 8, wherein a concentration of an aromatic functional group in raw material monomers constituting the resin binder is from 25 to 50% by weight.

* * * * *